US012692749B1

(12) United States Patent
Richards et al.

(10) Patent No.: US 12,692,749 B1
(45) Date of Patent: Jul. 28, 2026

(54) SYSTEMS AND METHODS FOR STEERING A DRILL BIT

(71) Applicant: Schlumberger Technology Corporation, Sugar Land, TX (US)

(72) Inventors: Edward Richards, Stonehouse (GB); Riadh Boualleg, Stonehouse (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/227,555

(22) Filed: Jun. 4, 2025

(51) Int. Cl.
*E21B 7/06* (2006.01)

(52) U.S. Cl.
CPC ..... *E21B 7/064* (2013.01)

(58) Field of Classification Search
CPC ..... E21B 7/064
See application file for complete search history.

(56) References Cited

U.S. PATENT DOCUMENTS

| | | | | |
|---|---|---|---|---|
| 11,118,406 | B2 * | 9/2021 | Caresta | E21B 10/42 |
| 11,920,459 | B2 * | 3/2024 | Li | E21B 45/00 |
| 12,297,737 | B1 * | 5/2025 | Downton | E21B 7/28 |
| 2010/0038141 | A1 * | 2/2010 | Johnson | E21B 17/1092 175/57 |
| 2010/0163312 | A1 * | 7/2010 | Chen | E21B 17/1092 29/592 |
| 2014/0353035 | A1 * | 12/2014 | Sugiura | E21B 7/04 175/40 |
| 2017/0211332 | A1 * | 7/2017 | Hird | E21B 7/28 |
| 2020/0003011 | A1 * | 1/2020 | Sihler | E21B 7/068 |
| 2021/0040796 | A1 * | 2/2021 | Azar | E21B 17/10 |
| 2021/0388679 | A1 * | 12/2021 | Marshall | E21B 10/55 |
| 2022/0034167 | A1 * | 2/2022 | Richards | E21B 17/10 |

* cited by examiner

*Primary Examiner* — Taras P Bemko
(74) *Attorney, Agent, or Firm* — Jeffrey D. Frantz

(57) ABSTRACT

A device may include a body having a longitudinal axis. A device may include a deployable steering pad radially movable relative to the body, wherein the deployable steering pad has a retracted state defining a retracted radius from the longitudinal axis and a deployed state defining a deployed radius from the longitudinal axis. A device may include a kicker plate connected to the body longitudinally adjacent to the deployable steering pad, wherein the kicker plate has a kicker radius from the longitudinal axis greater than the retracted radius. A device may include a cutting element positioned on the kicker plate and defining a cutting radius between the retracted radius and the deployed radius.

20 Claims, 8 Drawing Sheets

SYSTEMS AND METHODS FOR STEERING A DRILL BIT

BACKGROUND

For drilling of a borehole, directional drilling allows creation of a non-linear borehole or a linear borehole through varying earth formations. A drill bit breaks and clears formation material by rotation of the drill bit relative to the formation. Non-linear boreholes can be formed by steering a bit with lateral pushes from a rotary steerable device. The radius of a curve that is possible with a rotary steerable system is at least partially based on a distance from the steering pads to the bit.

SUMMARY

In some aspects, the techniques described herein relate to a rotary steering device including: a body having a longitudinal axis, a deployable steering pad radially movable relative to the body, wherein the deployable steering pad has a retracted state defining a retracted radius from the longitudinal axis and a deployed state defining a deployed radius from the longitudinal axis; a kicker plate connected to the body longitudinally adjacent to the deployable steering pad, wherein the kicker plate has a kicker radius from the longitudinal axis greater than the retracted radius; and a cutting element positioned on the kicker plate and defining a cutting radius between the retracted radius and the deployed radius.

In some aspects, the techniques described herein relate to a drilling system including: A drill bit including: a bit body having a plurality of blades and having a longitudinal axis, and a plurality of bit cutting elements defining a bit cutting profile with a bit cutting radius relative to the longitudinal axis; and a rotary steering device (RSD) coupled to the drill bit, the RSD including: an RSD body having the longitudinal axis, a deployable steering pad radially movable relative to the body, wherein the deployable steering pad has a retracted state defining a retracted radius from the longitudinal axis and a deployed state defining a deployed radius from the longitudinal axis; a kicker plate connected to the body longitudinally adjacent to the deployable steering pad, wherein the kicker plate has a kicker radius from the longitudinal axis greater than the retracted radius; and an RSD cutting element positioned on the kicker plate and defining an RSD cutting radius between the retracted radius and the deployed radius that is greater than the bit cutting radius.

In some aspects, the techniques described herein relate to a method of drilling a borehole, the method including: rotating a rotary steerable system (RSS) in a downhole environment, where the RSS includes an RSD and a drill bit; removing material from a formation in the downhole environment with bit cutting elements of the drill bit in at least a nose region and a shoulder region of a drill bit cutting profile; and removing material from the formation with RSD cutting elements on a kicker plate of the RSD.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and aspects of embodiments of the disclosure will be set forth in the description which follows, and in part will be obvious from the description, or may be learned by the practice of such embodiments. The features and aspects of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure, but not to scale for other embodiments contemplated herein. Understanding that the drawings depict some example embodiments, the embodiments will be described and explained with additional specificity and detail through the use of the accompanying drawings in which:

FIG. 7-1 is a schematic representation of cutting elements defining a tapered gauge surface, according to at least some embodiments of the present disclosure.

FIG. 7-2 is a schematic representation of cutting element defining a stepped gauge surface, according to at least some embodiments of the present disclosure.

DETAILED DESCRIPTION

Embodiments of the present disclosure generally relate to devices, systems, and methods for drilling a borehole. In some embodiments, a rotary steerable system (RSS) in a downhole environment can push the bit laterally. The RSS can, therefore, steer the drill bit in the downhole environment to drill a non-linear borehole. In some embodiments, the radius of curvature of the turn an RSS can create in the downhole environment is related to a distance between the drill bit and the deployable steering pads that are radially actuatable from the RSS. By shortening a distance between the bit and the steering pads, the RSS can be made more steerable.

In some embodiments, a drilling system according to the present disclosure includes a rotary steering device with cutting elements thereon. In some embodiments, the RSD cutting elements allow the removal of cutting elements from the bit. By "moving" cutting elements from the bit to the RSD, the bit is foreshortened, improving the steerability of the RSS. In some embodiments, the RSD elements define a gauge surface of a cutting profile of the RSS. In some embodiments, the RSD elements define a gauge surface and a shoulder surface of a cutting profile of the RSS. The cutting elements may be located on the RSD at a kicker plate longitudinally adjacent to the deployable steering pad. In some examples, the cutting elements are on a kicker plate downhole of the deployable steering pad. In some examples, the cutting elements are on a kicker plate uphole of the deployable steering pad.

Figure 1:
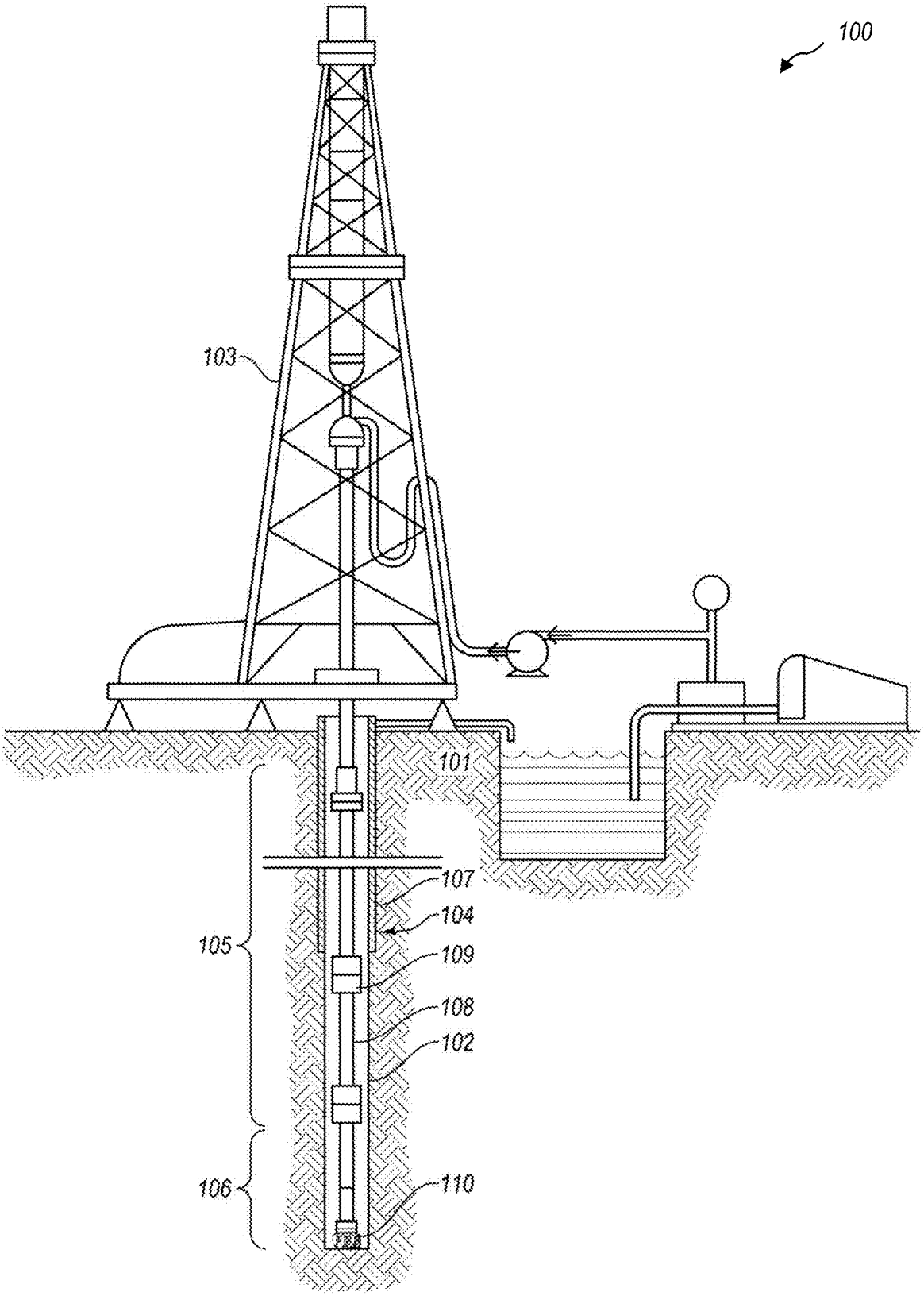
FIG. 1 illustrates a drilling system and downhole environment, according to at least some embodiments of the present disclosure.

FIG. 1 illustrates an embodiment of a drilling system and downhole environment. FIG. 1 shows one example of a drilling system 100 for drilling an earth formation 101 to form a borehole 102. The drilling system 100 includes a drill rig 103 used to turn a drilling assembly 104 which extends downward into the borehole 102. The drilling assembly 104 may include a drill string 105 and a bottomhole assembly (BHA) 106 attached to the downhole end of the drill string 105. Where the drilling system 100 is used for drilling formation, a drill bit 110 can be included at the downhole end of the BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, for lifting cuttings out of the borehole 102 as it is being drilled, and for preventing the collapse of the borehole 102. The drilling fluid carries drill solids including drill fines, drill cuttings, and other swarf from the borehole 102 to the surface based on a hydrostatic pressure of the borehole 102. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits, roller cone bits, impregnated bits, or coring bits. In other embodiments, the bit 110 may be a mill used for removing metal, composite, elastomer, other materials downhole, or combinations thereof. For instance, the bit 110 may be used with a whipstock to mill into casing 107 lining the borehole 102. The bit 110 may also be a junk mill used to mill away tools, plugs, cement, other materials within the borehole 102, or combinations thereof. Swarf or other cuttings formed by use of a mill may be lifted to surface by the drilling fluid or may be allowed to fall downhole. The conditions of the equipment of the drilling system 100, the formation 101, the borehole 102, the drilling fluid, or other part of the wellsite can change during operations.

In some embodiments, the BHA 106 and/or the drill string 105 includes one or more concentric torque transmission devices that receive an input torque from the uphole direction and convert the input torque to an output torque before transmitting the output torque in a downhole direction. For example, a concentric torque transmission device may receive an input torque from (e.g., be rotationally fixed relative to) the drill pipe 108 at the BHA 106 and convert the input torque to an output torque before transmitting the output torque to (e.g., be rotationally fixed relative to) the drill bit 110. In some embodiments, converting the input torque to the output torque changes a magnitude of the torque across the concentric torque transmission device, changes a magnitude of an angular velocity across the concentric torque transmission device, changes a direction of the torque across the concentric torque transmission device, changes a direction of the angular velocity across the concentric torque transmission device, or combinations thereof.

Figure 2:
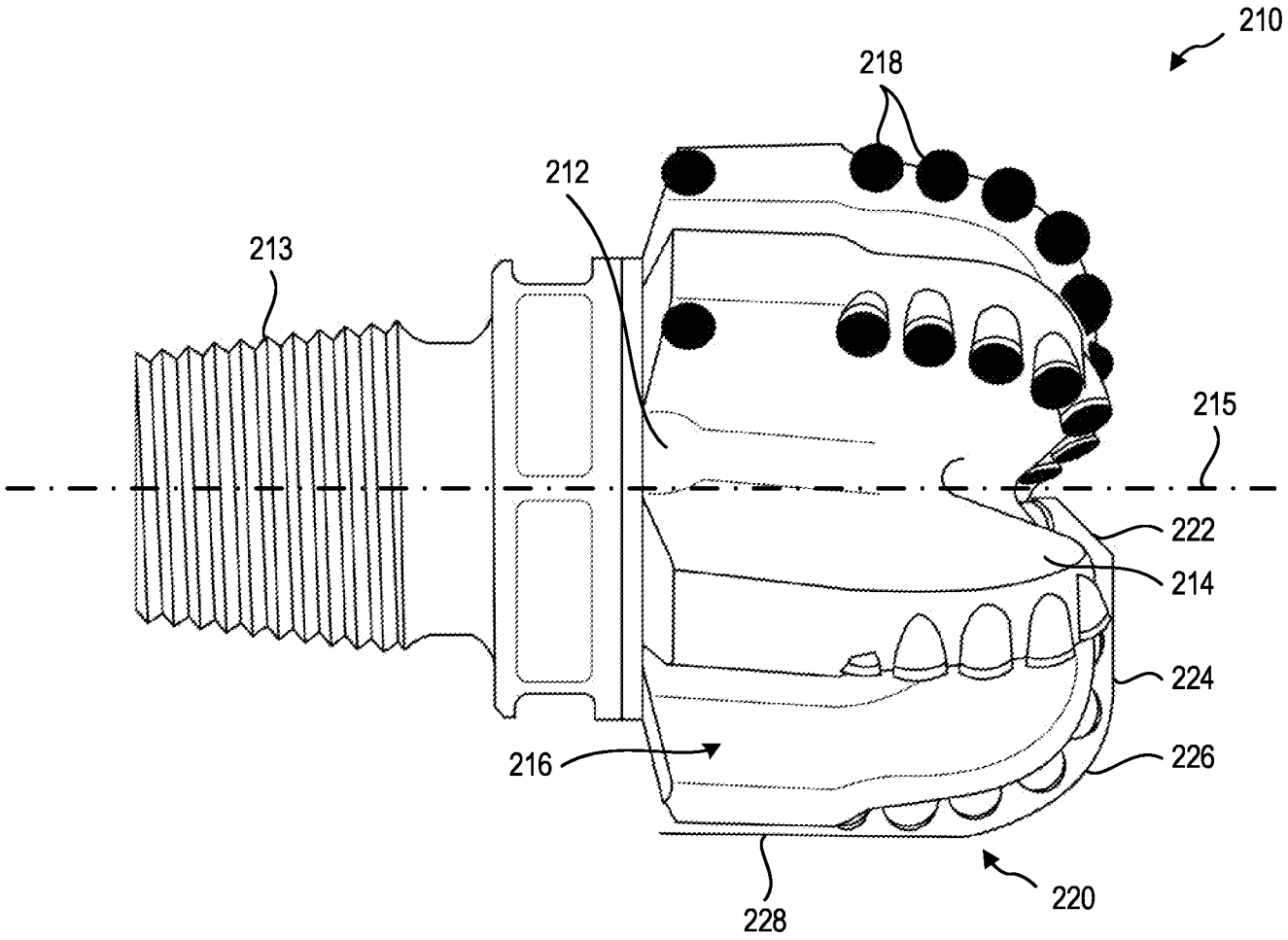
FIG. 2 (PRIOR ART)
FIG. 2 is a side view of a conventional drill bit.

FIG. 2 is a side view of an embodiment of a conventional drill bit 210 having a plurality of bit cutting elements that define a bit cutting profile. In some embodiments, a drill bit 210 includes a bit body 212 with a connector 213 connected thereto. In some examples, the connector 213 is a pin connector. In some examples, the connector 213 is a box connector. In some examples, the bit body 212 and the connector 213 are integrally formed as a single monolithic piece of continuous material (such as steel or carbide). In some examples, the bit body 212 and the connector 213 are formed of two pieces of material and joined together. For example, the bit body 212 may be or include tungsten carbide, and the connector 213 may be or include steel. In some embodiments, the bit body 212 and the connector 213 are made of or include the same material, but they are formed of two pieces of the material and joined together.

In some embodiments, the drill bit 210 includes a plurality of blades 214 protruding from the bit body 212 in a longitudinal direction and/or a radial direction relative to a longitudinal axis 215 of the drill bit 210. The blades 214 are separated by junk slots 216 between the blades 214 in an angular direction around the longitudinal axis 215. The junk slots 216 allow the drilling fluid and cuttings to flow past the blades 214 and away from the bit cutting elements 218 positioned on the blades 214.

In some embodiments, the bit cutting elements 218 are positioned on the longitudinal and/or radially outermost edges of the blades 214 and/or bit body 212 to scrape, fracture, degrade, or otherwise remove material from a formation. In some embodiments, the bit cutting elements 218 define a cutting profile 220 of the drill bit 210. In some embodiments, the summation of the blades 214 and bit cutting elements 218 thereon, when rotated into a single plane (as would be experienced by the formation upon rotation of the drill bit 210), define the cutting profile 220 of the drill bit 210.

The cutting profile 220 may include a cone 222 proximate to the longitudinal axis, a nose 224 radially outward of the cone 222, a shoulder radially outward from the nose 224, and a gauge 228 radially outward and longitudinally uphole from the shoulder 226. In some embodiments, the cutting profile 220 lacks a cone 222. In some embodiments according to the present disclosure, steerability of a drill bit is improved by the longitudinal shortening of the drill bit 210. The drill bit 210 may be shortened by moving at least some of the bit cutting elements 218 from the gauge 228 (and the associated longitudinal length of the bit body 212 and blades 216 along the gauge surface) to a body of a rotary steering device (RSD) of the drilling system that is coupled to the drill bit 210. In some embodiments, moving at least some of the bit cutting elements 218 from the gauge 228 to the RSD improves the steerability of the BHA by shortening the L1 distance, which is the distance from pad to bit.

More particularly, the dog leg severity (DLS) that is possible with a steerable system including a drill bit and an RSD is defined by:

$$DLS = \frac{2Eccn}{L1 \cdot L2}$$

where, Eccn is the permissible eccentricity in the hole, L1 is the longitudinal distance from the gauge surface of a conventional drill bit to the deployable steering pad of the rotary steering device, and L2 is the longitudinal distance from the deployable steering pad to a stabilization point. In some embodiments, the bit cutting elements that define the gauge portion of the cutting profile are removed and RSD cutting elements are positioned on a kicker plate of the RSD that is located downhole from a steering pad of the RSD, allowing the drill bit to be shortened, reducing the L1 to the distance from the uppermost (i.e., uphole-most) cutting element that defines the gauge to the deployable steering pad. In some embodiments, the bit cutting elements that define the gauge portion of the cutting profile are removed and RSD cutting elements are positioned on a kicker plate of the RSD that is located uphole from a steering pad of the RSD, allowing the drill bit to be shortened, further reducing the L1. In some embodiments, bit cutting elements that define the shoulder portion of the cutting profile are removed and RSD cutting elements are positioned on a kicker plate of the RSD that define a shoulder of a cutting profile of the combined system of the drill bit and RSD.

Figure 3:
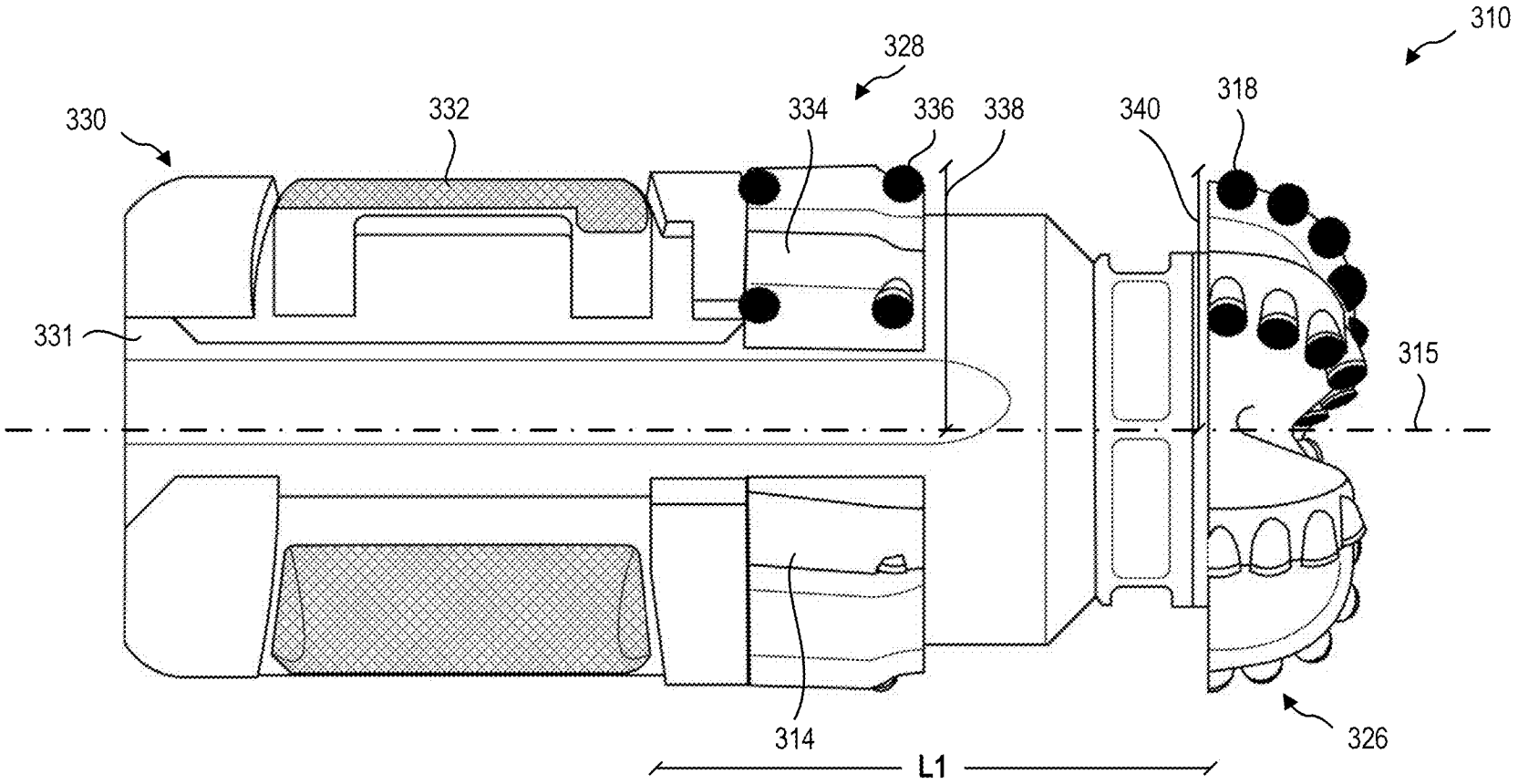
FIG. 3 is a side view of a rotary steerable system including a drill bit and a rotary steering device (RSD), according to at least some embodiments of the present disclosure.

FIG. 3 is a side view of an embodiment of part of a drilling system including a drill bit 310 and an RSD 330 according to at least some embodiments of the present disclosure. In some embodiments, the drill bit 310 lacks a gauge surface. The drill bit 310 may, therefore, have a shortened longitudinal length relative to a conventional drill bit (such as the drill bit 210, described in relation to FIG. 2), which has a conventional gauge surface. The gauge-less drill bit 310 may allow for a shortened L1 distance from the drill bit 310 to a deployable steering pad 332 of the RSD 330. In some embodiments, the L1 distance between a nearest bit cutting element and RSD cutting element is no more than 3 times the RSD cutting radius 338. In some embodiments, a longitudinal distance between a downhole-most bit cutting element and a downhole-most RSD cutting element is no more than 4 times the RSD cutting radius 338.

In some embodiments, the deployable steering pad 332 is movable in a radially outward direction from the body 331 of the RSD 330 relative to the longitudinal axis 315 of the RSD 330 and the drill bit 310. In some embodiments, the deployable steering pad 332 is selectively movable between a retracted state and a deployed state. In the retracted state, the deployable steering pad 332 is located as close to the body 331 of the RSD 330 as possible with the smallest radial distance from the longitudinal axis 315. In the deployed state, the deployable steering pad 332 is located as far from the body 331 of the RSD 330 as possible (without incurring damage to the RSD 330) with the largest radial distance from the longitudinal axis 315. The deployable steering pad 332 may be positioned at any position therebetween.

In some embodiments, the RSD 330 further includes a kicker plate 334 positioned longitudinally adjacent to the deployable steering pad 332. The kicker plate 334 may have positioned thereon at least one RSD cutting element 336 to remove material from the formation as the RSD 330 rotates in a downhole environment. In some embodiments, the kicker plate 334 includes one or more blades 314, similar to a drill bit, through which drilling fluid and cuttings may be evacuated. In some embodiments, the RSD cutting element (s) 336 defines an RSD cutting radius 338. In some embodiments, the RSD cutting radius 338 is substantially equal to a bit cutting radius 340 of the drill bit 310, where the kicker plate 334 and RSD cutting element(s) 336 function similarly to a gauge surface of a conventional drill bit. In some embodiments, the RSD cutting radius 338 is greater than a bit cutting radius 340 of the drill bit 310, where the kicker plate 334 and RSD cutting element(s) 336 function similarly to an extension of the shoulder 326 of the drill bit 310 and as a gauge surface 328 of the system. In some embodiments, the gauge surface 328 is a linear gauge surface parallel to the longitudinal axis 315. In some embodiments, the RSD cutting radius 338 is less than a bit cutting radius 340 of the drill bit 310, where the kicker plate 334 and RSD cutting element(s) 336 function similarly to a tapered gauge surface 328 or a gauge surface 328 with a radially-inward stepped gauge surface 328 that decreases in radius relative to the longitudinal axis 315.

It should be understood that, while embodiments of deployable steering pads 332 are described herein in relation to a kicker plate 334 uphole and/or downhole of the deployable steering pads 332, an RSD 330 according to the present disclosure may have a kicker plate 334 longitudinally adjacent to each deployable steering pad 332, a plurality of deployable steering pads 332, or at least one deployable steering pad 332. In some embodiments, each kicker plate 334 has the same arrangement of RSD cutting elements 336, the same shape of RSD cutting elements 336, the same quantity of RSD cutting elements 336, or combinations thereof. In some embodiments, at least two of the kicker plates 334 have the same arrangement of RSD cutting elements 336, the same shape of RSD cutting elements 336, the same quantity of RSD cutting elements 336, or combinations thereof. In some embodiments, at least two of the kicker plates 334 have a different arrangement of RSD cutting elements 336, a different shape of RSD cutting elements 336, a different quantity of RSD cutting elements 336, or combinations thereof.

Figure 4:
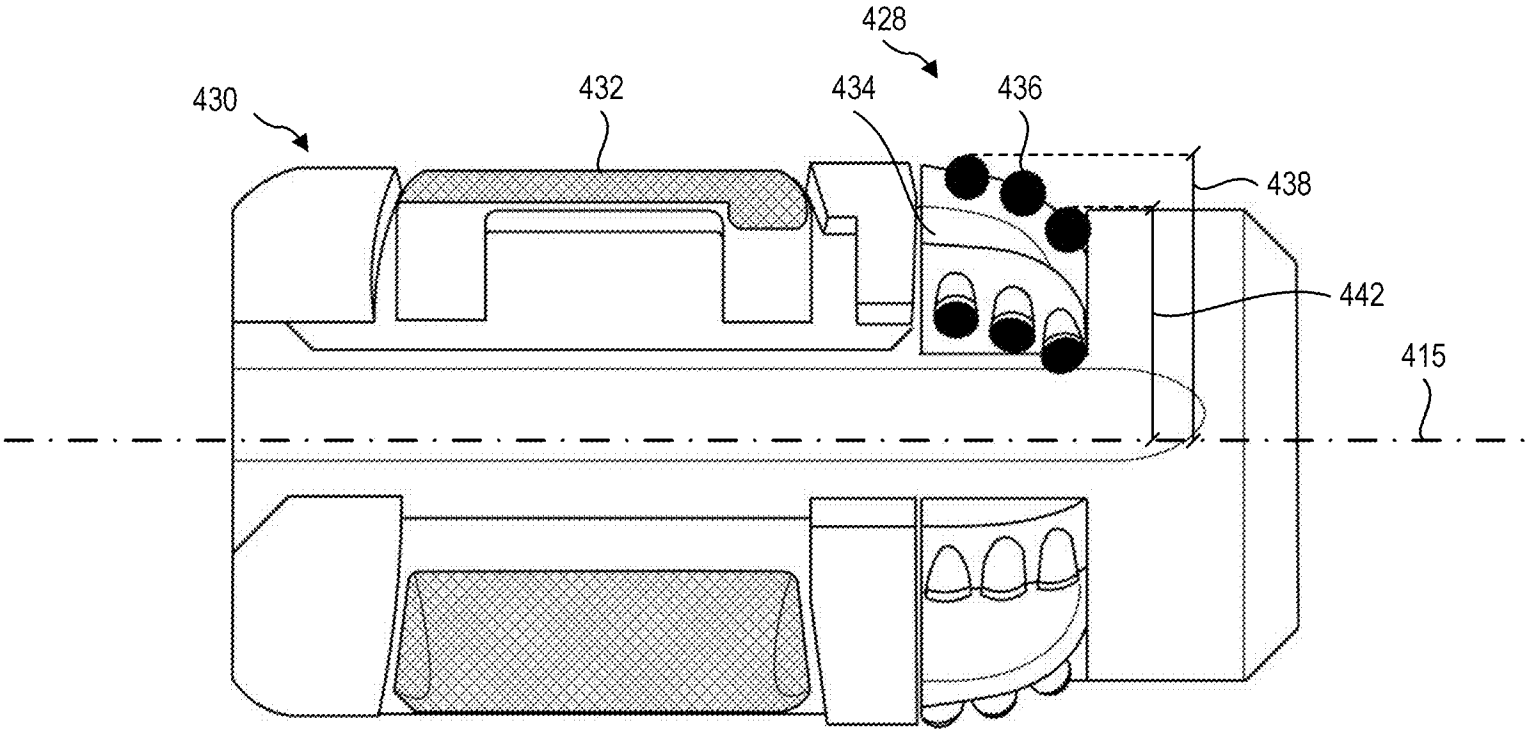
FIG. 4 is a side view of an RSD with a gauge surface of a cutting profile, according to at least some embodiments of the present disclosure.

In some embodiments, the kicker plate 334 has a first RSD cutting element 336 (or first row of RSD cutting elements 336 positioned in an angular row) and a second RSD cutting element 336 (or second row of RSD cutting elements 336) positioned uphole of the first RSD cutting element 336 (or first row of RSD cutting elements 336). In some embodiments, the first RSD cutting element(s) 336 defines a first RSD cutting radius 338, and the second RSD cutting element(s) defines a second RSD cutting radius. In some examples, the first RSD cutting radius is greater than the second RSD cutting radius. In some examples, the first RSD cutting radius is less than the second RSD cutting radius. In some examples, the first RSD cutting radius is the same as the second RSD cutting radius. In some embodiments, the kicker plate 334 has a longitudinal series of RSD cutting elements that define a straight line or curved line of a cutting profile of the RSD. For example, FIG. 4 is a side view of an embodiment of an RSD 430 with a cutting profile including a shoulder.

In some embodiments, an RSD 430 includes a kicker plate 434 with a plurality of RSD cutting elements 436 thereon. The plurality of RSD cutting elements 436 defines a shoulder that ranges from an inward RSD cutting radius 442 to an outward RSD cutting radius 438. In some embodiments, the plurality of RSD cutting elements 436 are arranged in at least three rows in the longitudinal direction of the longitudinal axis 415. In some embodiments, the rows of the plurality of RSD cutting elements 436 define a curved shoulder of the cutting profile. In some embodiments, the rows of the plurality of RSD cutting elements 436 define a linear shoulder of the cutting profile.

In some embodiments, the RSD 430 has one or more deployable steering pads 432 with a retracted state and a deployed state. In some embodiments, the deployable steering pads 432 in a retracted state defines a retracted radius relative to the longitudinal axis 415 that is between the inward RSD cutting radius 442 and an outward RSD cutting radius 438. In some embodiments, the deployable steering pads 432 in a retracted state defines a retracted radius relative to the longitudinal axis 415 that is less than the inward RSD cutting radius 442 of the shoulder of the RSD 430.

Figure 5:
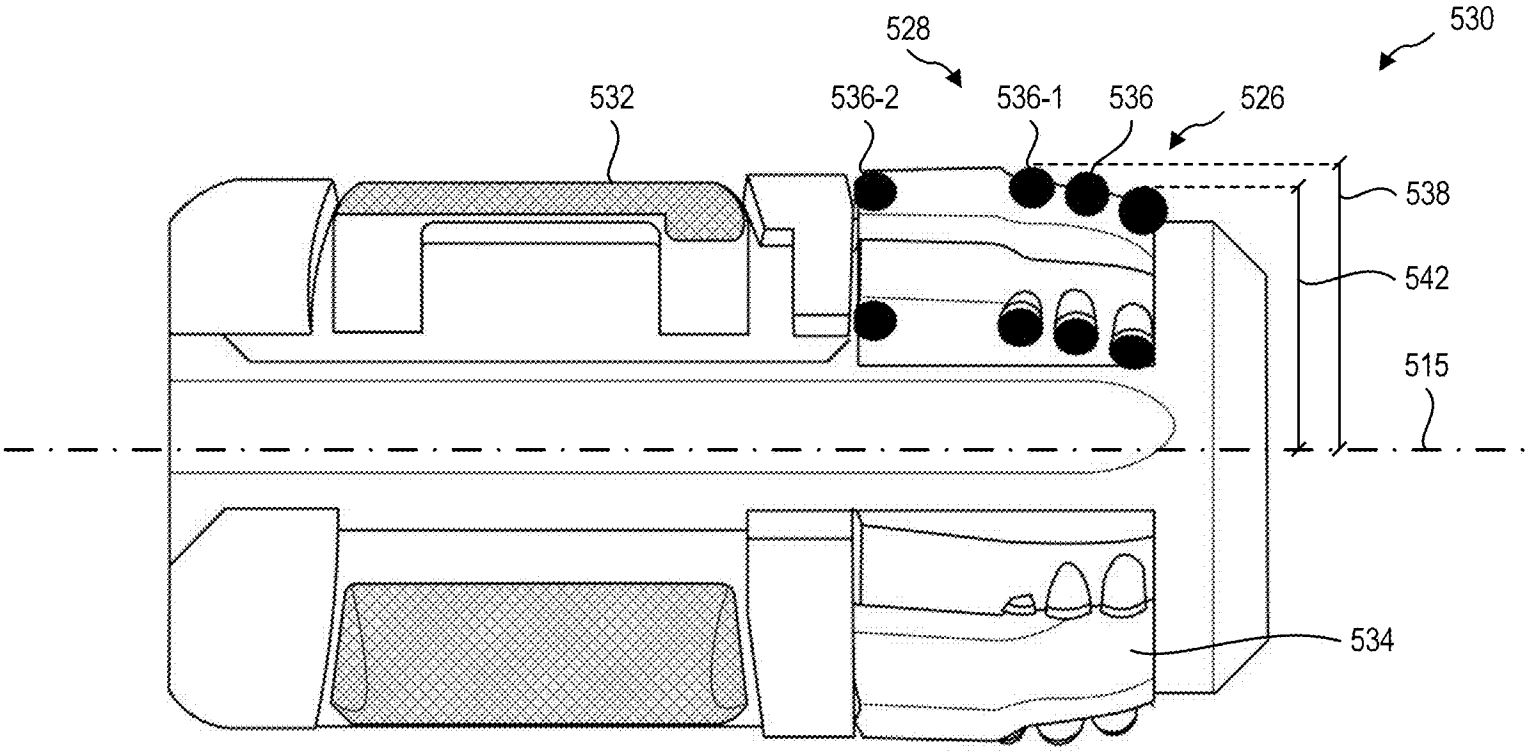
FIG. 5 is a side view of an RSD with a gauge surface and a shoulder surface of a cutting profile, according to at least some embodiments of the present disclosure.

In some embodiments, a radially outward-most RSD cutting element 436 defines at least a portion of the gauge 428 of the RSD 430. As described herein, the gauge 428 of the RSD 430 may include one or more rows of RSD cutting elements 436. In some embodiments, a first RSD cutting element(s) 436 of the gauge 428 defines a first RSD cutting radius and a second RSD cutting element(s) of the gauge 428 defines a second RSD cutting radius. In some examples, the first RSD cutting radius is different from the second RSD cutting radius. In some examples, the first RSD cutting radius is the same as the second RSD cutting radius. For example, FIG. 5 is a side view of an embodiment of an RSD 530 with a cutting profile including a shoulder 526 and a gauge surface 528.

In some embodiments, a kicker plate 534 includes a plurality of RSD cutting elements 536. The plurality of RSD cutting elements 536 defines a shoulder 526 that ranges from an inward RSD cutting radius 542 to an outward RSD cutting radius 538. In some embodiments, the plurality of RSD cutting elements 536 are arranged in at least three rows in the longitudinal direction of the longitudinal axis 515. In some embodiments, the rows of the plurality of RSD cutting elements 536 define a curved shoulder 526 of the cutting profile. In some embodiments, the rows of the plurality of RSD cutting elements 536 define a linear shoulder 526 of the cutting profile.

In some embodiments, the RSD 530 has one or more deployable steering pads 532 with a retracted state and a deployed state. In some embodiments, the deployable steering pads 532 in a retracted state defines a retracted radius relative to the longitudinal axis 515 that is between the inward RSD cutting radius 542 to an outward RSD cutting radius 538. In some embodiments, the deployable steering pads 532 in a retracted state defines a retracted radius relative to the longitudinal axis 515 that is less than the inward RSD cutting radius 542 of the shoulder 526 of the RSD 530.

In some embodiments, a radially outward-most RSD cutting element 536 defines at least a portion of the gauge 528 of the RSD 530. As described herein, the gauge 528 of the RSD 530 may include one or more rows of RSD cutting elements 536. In some embodiments, a first RSD cutting element(s) 536-1 of the gauge 528 defines a first RSD cutting radius and a second RSD cutting element(s) 536-2 of the gauge 528 defines a second RSD cutting radius. In some examples, the first RSD cutting radius is different from the second RSD cutting radius. In some examples, the first RSD cutting radius is the same as the second RSD cutting radius. In some embodiments, the first RSD cutting radius is the same as the outward RSD cutting radius 538 of the shoulder 526. In some embodiments, the cutting radius of the gauge 528 tapers inward in an uphole longitudinal direction.

Figure 6:
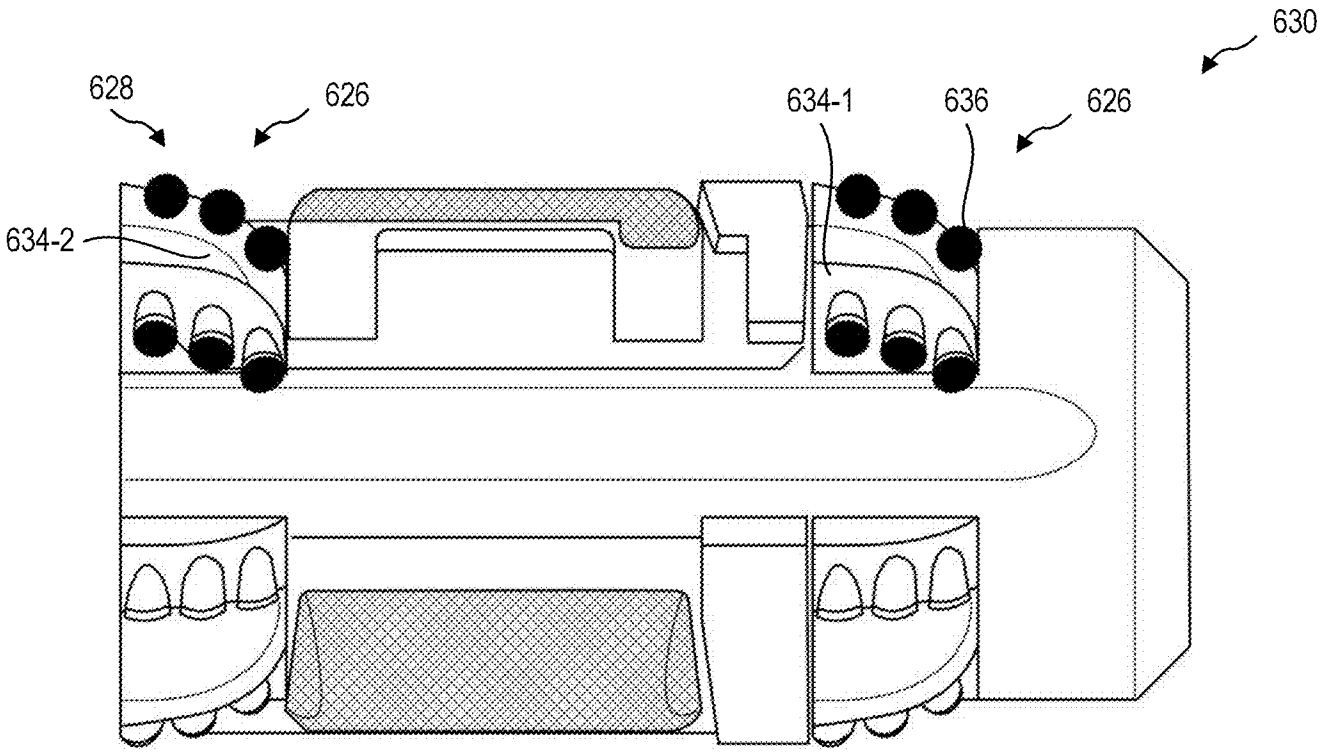
FIG. 6 is a side view of an RSD with cutting elements uphole and downhole of the deployable steering pad, according to at least some embodiments of the present disclosure.

FIG. 6 is a side view of an embodiment of an RSD 630 with a first kicker 634-1 with RSD cutting elements 636 thereon downhole of the deployable steering pad(s) and a second kicker 634-2 with RSD cutting elements 636 thereon uphole of the deployable steering pad(s). In some embodiments, the RSD cutting elements 636 of the first kicker 634-1 define at least a portion of a shoulder 626 of the cutting profile of the RSD 630. In some embodiments, the RSD cutting elements 636 of the first kicker 634-1 define a shoulder 626 and a gauge 628 of the cutting profile. In some embodiments, the RSD cutting elements 636 of the second kicker 634-2 define at least a portion of a shoulder 626 of the cutting profile of the RSD 630. In some embodiments, the RSD cutting elements 636 of the second kicker 634-2 define at least a portion of a shoulder 626 and a gauge 628 of the cutting profile. In at least one embodiment, the RSD cutting elements 636 of the first kicker 634-1 define a shoulder 626 of the RSD cutting profile and the RSD cutting elements 636 of the second kicker 634-2 define a gauge 628 of the RSD cutting profile. In at least one embodiment, the RSD cutting elements 636 of the first kicker 634-1 define a portion of a gauge 628 of the RSD cutting profile and the RSD cutting elements 636 of the second kicker 634-2 define another portion of the gauge 628 of the RSD cutting profile.

Figures 1, 7:
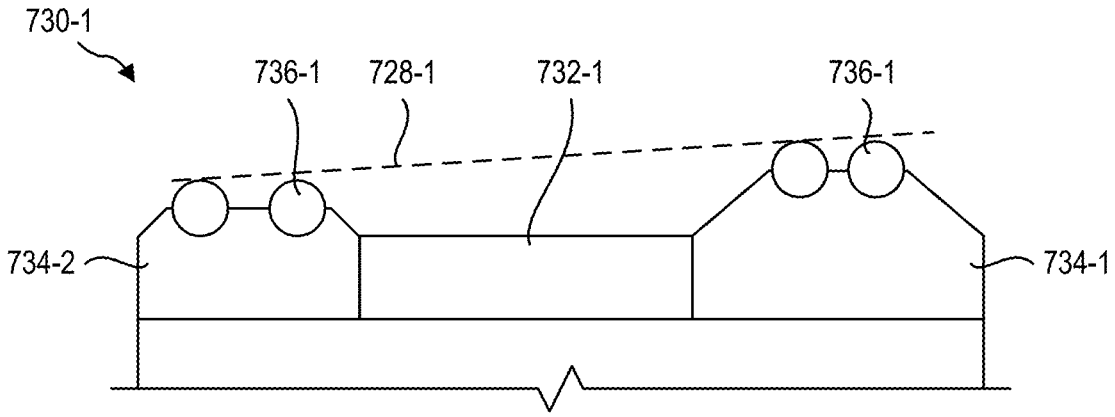
Figures 2, 7:
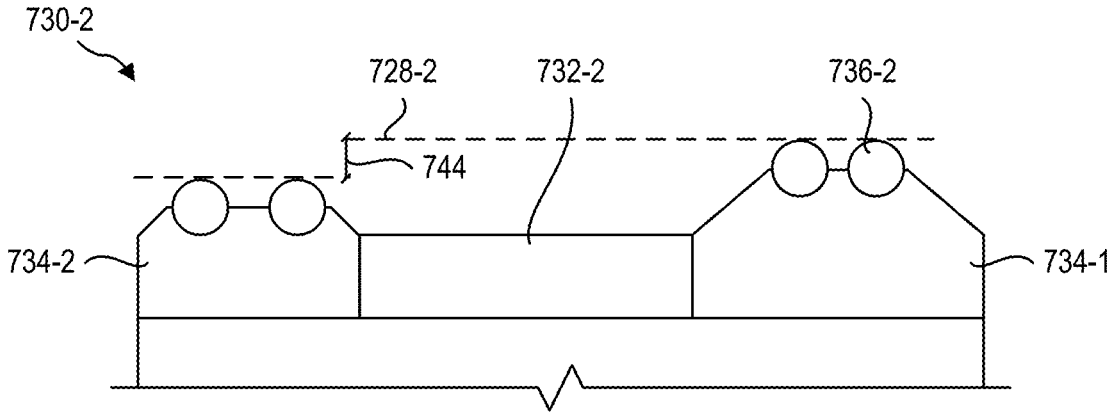

FIG. 7-1 and FIG. 7-2 are schematic diagrams of embodiments of gauge surface geometries that may be used with any of the RSD cutting profiles described herein. FIG. 7-1 is an example of a tapered gauge surface 728-1. The RSD cutting elements 736-1 of the first kicker plate 734-1 and the second kicker plate 734-2 on either adjacent longitudinal side of the deployable steering pad 732-1 define a single, continuous gauge surface 728-1 that tapers toward the longitudinal axis (e.g., a reducing gauge radius) of the RSD 730-1 in the uphole direction. In some embodiments, the RSD cutting elements 736-1 of the first kicker plate 734-1 and the second kicker plate 734-2 on either adjacent longitudinal side of the deployable steering pad 732-1 define a single, continuous gauge surface 728-1 that tapers toward the longitudinal axis (e.g., a reducing gauge radius) of the RSD 730-1 in the downhole direction.

FIG. 7-2 is an example of a stepped gauge surface 728-2. The RSD cutting elements 736-2 of the first kicker plate 734-1 define a first cutting radius of the stepped gauge surface 728-2 and the RSD cutting elements 736-2 of the second kicker plate 734-2 define a second cutting radius of the stepped gauge surface 728-2. The kicker plates are positioned on either adjacent longitudinal side of the deployable steering pad 732-2 and define a step 744 in the gauge of the RSD 730-2 that reduces the gauge radius toward the longitudinal axis in the uphole direction. It should be understood that any embodiment of an RSD described herein may include a tapered gauge surface of FIG. 7-1 or a stepped gauge surface of FIG. 7-2.

Figure 8:
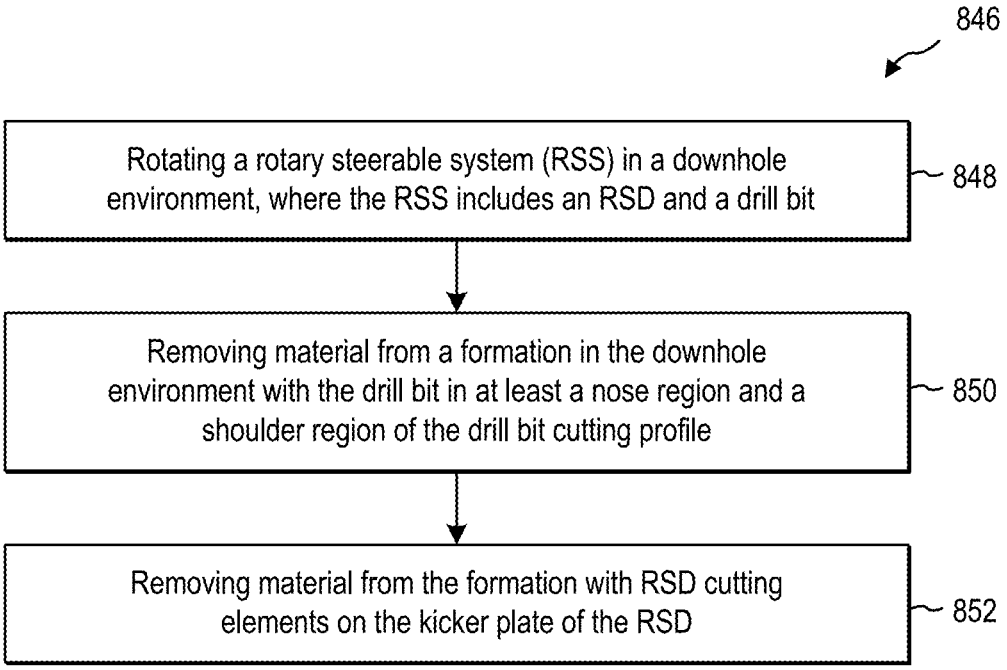
FIG. 8 is a method of drilling a borehole, according to at least some embodiments of the present disclosure.

FIG. 8 is a flowchart illustrating a method 846 of drilling a borehole, according to at least some embodiments of the present disclosure. In some embodiments, the method 846 includes rotating a rotary steerable system (RSS) in a downhole environment, where the RSS includes an RSD and a drill bit, at 848. In some embodiments, the drill bit is a gauge-less drill bit. In some embodiments, the RSD has gauge cutting elements positioned on a kicker plate thereof.

The method 846 further includes removing material from a formation in the downhole environment with the drill bit in at least a nose region and a shoulder region of the drill bit cutting profile at 850 and removing material from the formation with RSD cutting elements on the kicker plate of the RSD at 852. In some embodiments, the RSD cutting elements have a greater cutting radius than bit cutting elements. In some embodiments, the RSD cutting elements define a gauge surface of an RSD cutting profile. In some embodiments, the RSD cutting element define a shoulder of an RSD cutting profile. In some embodiments, the bit cutting elements cut the borehole to a first borehole diameter, and the RSD cutting elements increase the diameter of the borehole to a second borehole diameter that is greater than the first borehole diameter.

Because the RSD cutting elements are positioned on a kicker plate(s) of the RSD, the RSD cutting elements remove material and/or cut the borehole to an RSD cutting diameter independently of a state of the deployable steering pads of the RSD. For example, the RSD may steer in the borehole by actuating the deployable steering pads between a retracted state and a deployed state. In the retracted state, the RSD cutting elements may contact the borehole wall and remove material. In the deployed state, the RSD cutting elements may contact the borehole wall and remove material. In some embodiments, the RSD cutting elements are positioned on a kicker plate downhole of the deployable steering pad(s). In some embodiments, the RSD cutting elements are positioned on a kicker plate uphole of the deployable steering pad(s).

Embodiments of the present disclosure generally relate to devices, systems, and methods for drilling a borehole. In some embodiments, a rotary steerable system (RSS) in a downhole environment can push the bit laterally. The RSS can, therefore, steer the drill bit in the downhole environment to drill a non-linear borehole. In some embodiments, the radius of curvature of the turn an RSS can create in the downhole environment is related to a distance between the drill bit and the deployable steering pads that are radially actuatable from the RSS. By shortening a distance between the bit and the steering pads, the RSS can be made more steerable.

In some embodiments, a drilling system according to the present disclosure includes a rotary steering device with cutting elements thereon. In some embodiments, the RSD cutting elements allow the removal of cutting elements from the bit. By "moving" cutting elements from the bit to the RSD, the bit is foreshortened, improving the steerability of the RSS. In some embodiments, the RSD elements define a gauge surface of a cutting profile of the RSS. In some embodiments, the RSD elements define a gauge surface and a shoulder surface of a cutting profile of the RSS. The cutting elements may be located on the RSD at a kicker plate longitudinally adjacent to the deployable steering pad. In some examples, the cutting elements are on a kicker plate downhole of the deployable steering pad. In some examples, the cutting elements are on a kicker plate uphole of the deployable steering pad.

More particularly, the dog leg severity (DLS) that is possible with a steerable system including a drill bit and an RSD is defined by:

$$DLS = \frac{2Eccn}{L1 \cdot L2}$$

where, Eccn is the permissible eccentricity in the hole, L1 is the longitudinal distance from the gauge surface of the drill bit to the deployable steering pad of the rotary steering device, and L2 is the longitudinal distance from the deployable steering pad to a stabilization point. In some embodiments, the bit cutting elements that define the gauge portion of the cutting profile are removed and RSD cutting elements are positioned on a kicker plate of the RSD that is located downhole from a steering pad of the RSD, allowing the drill bit to be shortened, reducing the L1 to the distance from the uppermost (i.e., uphole-most) cutting element that defines the gauge to the deployable steering pad. In some embodiments, the bit cutting elements that define the gauge portion of the cutting profile are removed and RSD cutting elements are positioned on a kicker plate of the RSD that is located uphole from a steering pad of the RSD, allowing the drill bit to be shortened, further reducing the L1. In some embodiments, bit cutting elements that define the shoulder portion of the cutting profile are removed and RSD cutting elements are positioned on a kicker plate of the RSD that define a shoulder of a cutting profile of the combined system of the drill bit and RSD.

In some embodiments, the drill bit lacks a gauge surface. The drill bit may, therefore, have a shortened longitudinal length relative to a conventional drill bit, which has a conventional gauge surface. The gauge-less drill bit may allow for a shortened L1 distance from the drill bit to a deployable steering pad of the RSD. In some embodiments, the L1 distance between a nearest bit cutting element and RSD cutting element is no more than 3 times the RSD cutting radius. In some embodiments, a longitudinal distance between a downhole-most bit cutting element and a downhole-most RSD cutting element is no more than 4 times the RSD cutting radius.

In some embodiments, the deployable steering pad is movable in a radially outward direction from the body of the RSD relative to the longitudinal axis of the RSD and the drill bit. In some embodiments, the deployable steering pad is selectively movable between a retracted state and a deployed state. In the retracted state, the deployable steering pad is located as close to the body of the RSD as possible with the smallest radial distance from the longitudinal axis. In the deployed state, the deployable steering pad is located as far from the body of the RSD as possible (without incurring damage to the RSD) with the largest radial distance from the longitudinal axis. The deployable steering pad may be positioned at any position therebetween.

In some embodiments, the RSD further includes a kicker plate positioned longitudinally adjacent to the deployable steering pad. The kicker plate may have positioned thereon at least one RSD cutting element to remove material from the formation as the RSD rotates in a downhole environment. In some embodiments, the kicker plate includes one or more blades, similar to a drill bit, through which drilling fluid and cuttings may be evacuated. In some embodiments, the RSD cutting element(s) defines an RSD cutting radius. In some embodiments, the RSD cutting radius is substantially equal to a bit cutting radius of the drill bit, where the kicker plate and RSD cutting element(s) function similarly to a gauge surface of a conventional drill bit. In some embodiments, the RSD cutting radius is greater than a bit cutting radius of the drill bit, where the kicker plate and RSD cutting element(s) function similarly to an extension of the shoulder of the drill bit and as a gauge surface of the system. In some embodiments, the gauge surface is a linear gauge surface parallel to the longitudinal axis. In some embodiments, the RSD cutting radius is less than a bit cutting radius of the drill bit, where the kicker plate and RSD cutting element(s) function similarly to a tapered gauge surface or a gauge surface with a radially-inward stepped gauge surface that decreases in radius relative to the longitudinal axis.

It should be understood that, while embodiments of deployable steering pads are described herein in relation to a kicker plate uphole and/or downhole of the deployable steering pads, an RSD according to the present disclosure may have a kicker plate longitudinally adjacent to each deployable steering pad, a plurality of deployable steering pads, or at least one deployable steering pad. In some embodiments, each kicker plate has the same arrangement of RSD cutting elements, the same shape of RSD cutting elements, the same quantity of RSD cutting elements, or combinations thereof. In some embodiments, at least two of the kicker plates have the same arrangement of RSD cutting elements, the same shape of RSD cutting elements, the same quantity of RSD cutting elements, or combinations thereof. In some embodiments, at least two of the kicker plates have a different arrangement of RSD cutting elements, a different shape of RSD cutting elements, a different quantity of RSD cutting elements, or combinations thereof.

In some embodiments, the kicker plate has a first RSD cutting element (or first row of RSD cutting elements positioned in an angular row) and a second RSD cutting element (or second row of RSD cutting elements) positioned uphole of the first RSD cutting element (or first row of RSD cutting elements). In some embodiments, the first RSD cutting element(s) defines a first RSD cutting radius, and the second RSD cutting element(s) defines a second RSD cutting radius. In some examples, the first RSD cutting radius is greater than the second RSD cutting radius. In some examples, the first RSD cutting radius is less than the second RSD cutting radius. In some examples, the first RSD cutting radius is the same as the second RSD cutting radius. In some embodiments, the kicker plate has a longitudinal series of RSD cutting elements that define a straight line or curved line of a cutting profile of the RSD.

In some embodiments, an RSD includes a kicker plate with a plurality of RSD cutting elements thereon. The plurality of RSD cutting elements defines a shoulder that ranges from an inward RSD cutting radius to an outward RSD cutting radius. In some embodiments, the plurality of RSD cutting elements are arranged in at least three rows in the longitudinal direction of the longitudinal axis. In some embodiments, the rows of the plurality of RSD cutting elements define a curved shoulder of the cutting profile. In some embodiments, the rows of the plurality of RSD cutting elements define a linear shoulder of the cutting profile.

In some embodiments, the RSD has one or more deployable steering pads with a retracted state and a deployed state. In some embodiments, the deployable steering pads in a retracted state defines a retracted radius relative to the longitudinal axis that is between the inward RSD cutting radius to an outward RSD cutting radius. In some embodiments, the deployable steering pads in a retracted state defines a retracted radius relative to the longitudinal axis that is less than the inward RSD cutting radius of the shoulder of the RSD.

In some embodiments, a radially outward-most RSD cutting element defines at least a portion of the gauge of the RSD. As described herein, the gauge of the RSD may include one or more rows of RSD cutting elements. In some embodiments, a first RSD cutting element(s) of the gauge defines a first RSD cutting radius and a second RSD cutting element(s) of the gauge defines a second RSD cutting radius. In some examples, the first RSD cutting radius is different from the second RSD cutting radius. In some examples, the first RSD cutting radius is the same as the second RSD cutting radius.

In some embodiments, a kicker plate includes a plurality of RSD cutting elements. The plurality of RSD cutting elements defines a shoulder that ranges from an inward RSD cutting radius to an outward RSD cutting radius. In some embodiments, the plurality of RSD cutting elements are arranged in at least three rows in the longitudinal direction of the longitudinal axis. In some embodiments, the rows of the plurality of RSD cutting elements define a curved shoulder of the cutting profile. In some embodiments, the rows of the plurality of RSD cutting elements define a linear shoulder of the cutting profile.

In some embodiments, the RSD has one or more deployable steering pads with a retracted state and a deployed state. In some embodiments, the deployable steering pads in a retracted state defines a retracted radius relative to the longitudinal axis that is between the inward RSD cutting radius to an outward RSD cutting radius. In some embodiments, the deployable steering pads in a retracted state defines a retracted radius relative to the longitudinal axis that is less than the inward RSD cutting radius of the shoulder of the RSD.

In some embodiments, a radially outward-most RSD cutting element defines at least a portion of the gauge of the RSD. As described herein, the gauge of the RSD may include one or more rows of RSD cutting elements. In some embodiments, a first RSD cutting element(s) of the gauge defines a first RSD cutting radius and a second RSD cutting element(s) of the gauge defines a second RSD cutting radius. In some examples, the first RSD cutting radius is different from the second RSD cutting radius. In some examples, the first RSD cutting radius is the same as the second RSD cutting radius. In some embodiments, the first RSD cutting radius is the same as the outward RSD cutting radius of the shoulder. In some embodiments, the cutting radius of the gauge tapers inward in an uphole longitudinal direction.

In some embodiments, the RSD cutting elements of the first kicker define at least a portion of a shoulder of the cutting profile of the RSD. In some embodiments, the RSD cutting elements of the first kicker define a shoulder and a gauge of the cutting profile. In some embodiments, the RSD cutting elements of the second kicker define at least a portion of a shoulder of the cutting profile of the RSD. In some embodiments, the RSD cutting elements of the second kicker define at least a portion of a shoulder and a gauge of the cutting profile. In at least one embodiment, the RSD cutting elements of the first kicker define a shoulder of the RSD cutting profile and the RSD cutting elements of the second kicker define a gauge of the RSD cutting profile. In at least one embodiment, the RSD cutting elements of the first kicker define a portion of a gauge of the RSD cutting profile and the RSD cutting elements of the second kicker define another portion of the gauge of the RSD cutting profile. It should be understood that any embodiment of an RSD described herein may include a tapered gauge surface or a stepped gauge surface.

In some embodiments, a method of drilling a borehole includes rotating an RSS in a downhole environment, where the RSS includes an RSD and a drill bit. In some embodiments, the drill bit is a gauge-less drill bit. In some embodiments, the RSD has gauge cutting elements positioned on a kicker plate thereof.

The method further includes removing material from a formation in the downhole environment with the drill bit in at least a nose region and a shoulder region of the drill bit cutting profile and removing material from the formation with RSD cutting elements on the kicker plate of the RSD. In some embodiments, the RSD cutting elements have a greater cutting radius that then bit cutting elements. In some embodiments, the RSD cutting elements define a gauge surface of an RSD cutting profile. In some embodiments, the RSD cutting element define a shoulder of an RSD cutting profile. In some embodiments, the bit cutting elements cut the borehole to a first borehole diameter, and the RSD cutting elements increase the diameter of the borehole to a second borehole diameter that is greater than the first borehole diameter.

Because the RSD cutting elements are positioned on a kicker plate(s) of the RSD, the RSD cutting elements remove material and/or cut the borehole to an RSD cutting diameter independently of a state of the deployable steering pads of the RSD. For example, the RSD may steer in the borehole by actuating the deployable steering pads between a retracted state and a deployed state. In the retracted state, the RSD cutting elements may contact the borehole wall and remove material. In the deployed state, the RSD cutting elements may contact the borehole wall and remove material. In some embodiments, the RSD cutting elements are positioned on a kicker plate downhole of the deployable steering pad(s). In some embodiments, the RSD cutting elements are positioned on a kicker plate uphole of the deployable steering pad(s).

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A rotary steering device comprising:

a body having a longitudinal axis, one or more deployable steering pads radially movable relative to the body, wherein each of the one or more deployable steering pads has a retracted state defining a retracted radius from the longitudinal axis and a deployed state defining a deployed radius from the longitudinal axis;

a first kicker plate connected to the body longitudinally adjacent to the one or more deployable steering pads in a downhole longitudinal position offset downhole from the one or more deployable steering pads, wherein the first kicker plate has a first plurality of cutting elements that are mounted on the first kicker plate at downhole longitudinal positions offset completely downhole from all of the one or more deployable steering pads and arranged in a series or rows at a first plurality of different axial positions with increasing cutting radius in an uphole direction, wherein the first plurality of cutting elements define a first cutting radius between the retracted radius and the deployed radius; and a second kicker plate connected to the body longitudinally adjacent to the one or more deployable steering pads in an uphole longitudinal position offset uphole from the one or more deployable steering pads, wherein the second kicker plate has a second plurality of cutting elements that are mounted on the second kicker plate at uphole longitudinal positions offset completely uphole from all of the one or more deployable steering pads opposite the first plurality of cutting elements and arranged in a series or rows at a second plurality of different axial positions with increasing cutting radius in the uphole direction, wherein the second plurality of cutting elements define a second cutting radius between the retracted radius and the deployed radius, wherein the first and second kicker plates are separate and axially offset from one another in the respective downhole and uphole longitudinal positions, wherein the rotary steering device excludes cutting elements over an axial distance including all of the one or more deployable steering pads.

2. The rotary steering device of claim 1, wherein the second cutting radius is greater than the first cutting radius.

3. The rotary steering device of claim 1, wherein the first plurality of cutting elements of the first kicker plate and the second plurality of cutting elements of the second kicker plate define a tapered gauge that extends relative to the longitudinal axis.

4. The rotary steering device of claim 1, wherein the one or more deployable steering pads is part of a plurality of deployable steering pads positioned angularly around the longitudinal axis, and each deployable steering pad of the plurality of deployable steering pads includes respective first and second kicker plates connected to the body longitudinally adjacent to the deployable steering pad of the plurality of deployable steering pads.

5. The rotary steering device of claim 1, wherein the first plurality of cutting elements is arranged in the first plurality of different axial positions in each of a first plurality of circumferentially spaced groups about the longitudinal axis, and the second plurality of cutting elements is arranged in the second plurality of different axial positions in each of a second plurality of circumferentially spaced groups about the longitudinal axis.

6. The rotary steering device of claim 5, wherein the first plurality of different axial positions comprise three different axial positions, the second plurality of different axial positions comprise three different axial positions, or both.

7. The rotary steering device of claim 5, wherein the first plurality of circumferentially spaced groups comprises at least three circumferentially spaced groups, the second plurality of circumferentially spaced groups comprises at least three circumferentially spaced groups, or both.

8. The rotary steering device of claim 5, wherein each of the first plurality of circumferentially spaced groups comprises a first curved series of the first plurality of cutting elements disposed at the first plurality of different axial positions along a first curved line, wherein each of the second plurality of circumferentially spaced groups comprises a second curved series of the second plurality of cutting elements disposed at the second plurality of different axial positions along a second curved line, wherein each of the first and second plurality of different axial positions comprise three different axial positions, wherein each of the first and second plurality of circumferentially spaced groups comprises at least four circumferentially spaced groups.

9. A drilling system comprising:

a drill bit including:

a bit body having a plurality of blades, and a plurality of bit cutting elements defining a bit cutting profile with a bit cutting radius; and a rotary steering device (RSD) coupled to the drill bit, the RSD including:

an RSD body having a longitudinal axis, a plurality of deployable steering pads radially movable relative to the RSD body, wherein each of the plurality of deployable steering pads has a retracted state defining a retracted radius from the longitudinal axis and a deployed state defining a deployed radius from the longitudinal axis, a first kicker plate connected to the RSD body longitudinally adjacent to the plurality of deployable steering pads in a downhole longitudinal position offset downhole from the plurality of deployable steering pads, wherein the first kicker plate has a first plurality of RSD cutting elements that are mounted on the first kicker plate at downhole longitudinal positions offset completely downhole from all of the plurality of deployable steering pads and arranged in a series or rows at a first set of at least three different axial positions with increasing cutting radius in an uphole direction, wherein the first plurality of RSD cutting elements define a first RSD cutting radius between the retracted radius and the deployed radius that is greater than the bit cutting radius, and a second kicker plate connected to the RSD body longitudinally adjacent to the plurality of deployable steering pads in an uphole longitudinal position offset uphole from the plurality of deployable steering pads, wherein the second kicker plate has a second plurality of RSD cutting elements that are mounted on the second kicker plate at uphole longitudinal positions offset completely uphole from all of the plurality of deployable steering pads opposite the first plurality of RSD cutting elements and arranged in a series or rows at a second set of at least three different axial positions with increasing cutting radius in the uphole direction, wherein the second plurality of RSD cutting elements define a second RSD cutting radius between the retracted radius and the deployed radius that is greater than the bit cutting radius, wherein the first and second kicker plates are separate and axially offset from one another in the respective downhole and uphole longitudinal positions, wherein the RSD excludes RSD cutting elements over an axial distance including all of the plurality of deployable steering pads.

10. The drilling system of claim 9, wherein the bit cutting profile lacks a gauge surface.

11. The drilling system of claim 9, wherein the bit cutting profile lacks a shoulder surface.

12. The drilling system of claim 9, wherein a longitudinal distance between a nearest bit cutting element an RSD cutting element is no more than 3 times the first RSD cutting radius and the second RSD cutting radius.

13. The drilling system of claim 9, wherein a longitudinal distance between a downhole-most bit cutting element and a downhole-most RSD cutting element is no more than 4 times the first RSD cutting radius and the second RSD cutting radius.

14. A method of drilling a borehole, the method comprising:

rotating the drilling system of claim 9 in a downhole environment;

removing material from a formation in the downhole environment with the bit cutting elements of the drill bit; and removing material from the formation in the downhole environment with the first plurality of RSD cutting elements mounted on the first kicker plate and with the second plurality of RSD cutting elements mounted on the second kicker plate.

15. The method of claim 14, wherein the bit cutting elements cut a diameter of the borehole to a first borehole diameter, and the first plurality of RSD cutting elements and the second plurality of RSD cutting elements increase the diameter of the borehole to a second borehole diameter greater than the first borehole diameter.

16. The method of claim 14, wherein the first plurality of RSD cutting elements and the second plurality of RSD cutting elements remove material from the formation independently of a state of the plurality of deployable steering pads of the RSD.

17. The system of claim 9, wherein the first plurality of RSD cutting elements comprises at least two RSD cutting elements circumferentially offset from one another about the longitudinal axis at each axial position of the first set of at least three different axial positions, and the second plurality of RSD cutting elements comprises at least two RSD cutting elements circumferentially offset from one another about the longitudinal axis at each axial position of the second set of at least three different axial positions.

18. The system of claim 9, wherein the first plurality of RSD cutting elements comprises at least three RSD cutting elements circumferentially offset from one another about the longitudinal axis at each axial position of the first set of at least three different axial positions, and the second plurality of RSD cutting elements comprises at least three RSD cutting elements circumferentially offset from one another about the longitudinal axis at each axial position of the second set of at least three different axial positions.

19. The system of claim 9, wherein the first plurality of RSD cutting elements comprises at least four RSD cutting elements circumferentially offset from one another about the longitudinal axis at each axial position of the first set of at least three different axial positions, and the second plurality of RSD cutting elements comprises at least four RSD cutting elements circumferentially offset from one another about the longitudinal axis at each axial position of the second set of at least three different axial positions.

20. The system of claim 9, wherein the first plurality of RSD cutting elements is arranged in a first curved series of the first set of at least three different axial positions in each of a first plurality of circumferentially spaced groups about the longitudinal axis, wherein the second plurality of RSD cutting elements is arranged in a second curved series of the second set of at least three different axial positions in each of a second plurality of circumferentially spaced groups about the longitudinal axis, wherein each of the first and second plurality of circumferentially spaced groups comprises at least three circumferentially spaced groups.

* * * * *